United States Patent [19]

Takamatsu

[11] 3,947,931

[45] Apr. 6, 1976

[54] SLIDING CLASP FASTENER

[75] Inventor: Ikuo Takamatsu, Uozu, Japan

[73] Assignee: Yoshida Kogyo Kabushiki Kaisha, Japan

[22] Filed: Dec. 27, 1974

[21] Appl. No.: 536,826

[30] Foreign Application Priority Data

Dec. 29, 1973 Japan ..... 49-493166[U]

[52] U.S. Cl. ..... 24/205.16 C; 24/205.13 C

[51] Int. Cl.[2] ..... A44B 19/40; A44B 19/10

[58] Field of Search 24/205.13 C, 205.1 C, 205.16 C

[56] References Cited

UNITED STATES PATENTS

| | | | |
|---|---|---|---|
| 3,328,857 | 7/1967 | Burbank | 24/205.13 C |
| 3,336,640 | 8/1967 | Chery | 24/205.13 C |
| 3,490,111 | 1/1970 | Waldes | 24/205.16 C |
| 3,691,599 | 9/1972 | Maisenbacher | 24/205.13 C |

*Primary Examiner*—Bernard A. Gelak

*Attorney, Agent, or Firm*—Bucknam and Archer

[57] ABSTRACT

A sliding clasp fastener including interlocking elements of a continued meander structure which are disposed astride a longitudinal tape edge at their leg and connecting portions. The leg and connecting portions are deformed to provide flattened, enlarged undersurfaces adapted to be held in intimate contact with the tape. The connecting portions are also deformed to produce recesses for receiving therein side flanges of a slider.

2 Claims, 3 Drawing Figures

SLIDING CLASP FASTENER

BACKGROUND OF THE INVENTION

This invention relates generally to sliding clasp fasteners and in particular to a sliding clasp fastener of the type having a pair of rows of interlocking elements formed from a plastics filament into a meander structure.

In a sliding clasp fastener including a row of meander-type elements produced by bending a plastics filament, it is the customary practice to attach the elements by bonding or fusing to a stringer tape. However, this process of attachment has the drawback that due to extremely limited areas of contact between the tape and the elements, the elements are liable to disengage from the tape when subjected to severe external stresses. Various attempts have heretofore been made to explore more effective and secure attachment of the fastener elements other than by adhesive bonding or fusing. Normally, such attempts have involved additional manufacturing steps as regards a particular area of the tape at which the row of interlocking elements is to be mounted. One such attempt was to form a corrugated surface on a marginal edge portion of the tape in order to ensure increased mating engagement of the row of interlocking elements with the tape. Another attempt included, in addition to the bonding or fusing treatment, the provision of a plurality of apertures in the tape for passing the sewing threads that secure the elements to the tape. However, these prior-art efforts have only led to complicated, time-consuming manufacturing operation. Furthermore, with the construction of the prior-art sliding clasp fastener, the fabric of the tape adjacent the row of elements has suffered from wear or damage in repeated frictional engagement with a reciprocating slider.

SUMMARY OF THE INVENTION

It is therefore the principal object of the present invention to provide an improved sliding clasp fastener which will eliminate the above-noted difficulties.

Other objects and advantages of the invention will become more readily apparent from a consideration of the following description and the accompanying drawings.

DETAILED DESCRIPTION OF THE PREFERRED EMBODIMENT

Figure 1:
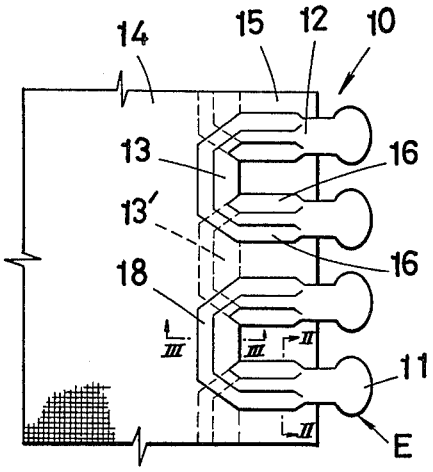
FIG. 1 is a fragmentary plan view of a sliding clasp fastener constructed in accordance with the present invention, but showing one of a pair of stringer tapes carrying a row of meander-type interlocking fastener elements.
Figure 2:
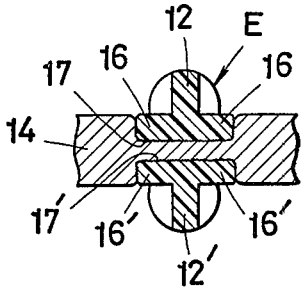
FIG. 2 is a cross-sectional view taken along the line II—II of FIG. 1.
Figure 3:
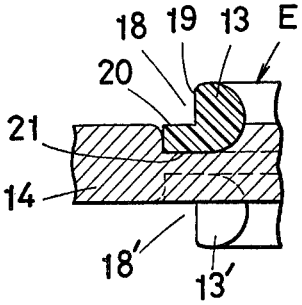
FIG. 3 is a cross-sectional view taken along the line III—III of FIG. 1.

Referring to the drawings and particularly to FIG. 1, there is shown a row of interlocking elements E generally designated by reference numeral 10 which is formed by bending a plastics filament of substantially round cross section into a meander structure. Each element E has a coupling head 11, two legs 12 and 12' and connecting portion 13 formed remote from the coupling head 11. The row of elements E is mounted on the tape 14 with their legs 12 disposed astride one longitudinal marginal edge 15, so that the legs appear on the respective sides of the tape. According to an important aspect of the present invention, the legs 12 and 12' are each provided at lateral sides thereof with deformed portions 16 and each has a flattened, enlarged undersurface 17 adapted to be held in intimate contact with one side of the stringer tape 14. The connecting portions 13 and 13' are also deformed to provide recesses 18 and 18' remote from the coupling head 11 each defined by a vertical wall 19 and a horizontal wall 20 which lies substantially flush with the surface of the tape. The connecting portions 13 and 13' are further provided each with a flattened, enlarged undersurface 21 adapted to be held in intimate contact with one side of the stringer tape 14. The recesses 18 and 18' are so configured as to snugly receive therein the side flanges of a slider not shown. Each row of interlocking elements E thus constructed is mounted astride the marginal edge 15 of the respective stringer tape 14 with the coupling heads 11 projecting beyond the extremity of the tape edge. To permanently secure the row of interlocking elements to the stringer tape, the flattened, enlarged under-surfaces of the leg portions and the connecting portions are bonded or fused to the stringer tape with use of an adhesive compound or by means of high frequency or supersonic processing. It is to be noted that the flattened, enlarged undersurfaces 17 and 17' of the interlocking elements provide the increased contact area for bonding or fusing attachment of the elements to the stringer tape thereby anchoring the row of elements into position on the tape against possible displacement under the influence of external stresses.

The provision of recesses 18 and 18' in the connecting portion serves the purpose of facilitating the movement of the slider as the latter is allowed to slide smoothly therealong without coming into frictional conact with the tape fabric. If required, there may be employed sewing threads, not shown, so as to further ensure stable attachment of the elements to the tape.

What is claimed is:

1. In a sliding clasp fastener including a pair of oppositely disposed stringer tapes each having a row of interlocking elements formed from a plastics filament into a continuous meandering structure, said elements each having two leg portions disposed astride of one longitudinal edge of said tape, a coupling head extending from said leg portions and adapted to interlock with that of an opposed interlocking element, and a connecting portion lying remote from said coupling head and connecting two adjacent interlocking elements, the improvement which comprises said leg portions being provided each with flattened oppositely projecting side portions, a flattened central portion projecting transversely with respect to said side portions, and a flattened, enlarged undersurface disposed for contact with the stringer tape, and said connecting portion being provided at the outer side thereof with a recess for receiving therein a side flange of a slider, with a flattened, enlarged undersurface disposed for contact with the stringer tape.

2. The improvement according to claim 1 wherein said recess is defined by a vertical wall and horizontal wall of said connecting portion, said horizontal wall being positioned to lie substantially flush with one surface of the stringer tape adjacent the horizontal wall.

* * * * *